US005254424A

United States Patent [19]

Felder

[11] Patent Number: 5,254,424

[45] Date of Patent: Oct. 19, 1993

[54] HIGH SOLIDS REPLENISHABLE LIQUID DEVELOPER CONTAINING URETHANE-MODIFIED POLYESTER TONER RESIN

[75] Inventor: Thomas Felder, Pannal, England

[73] Assignee: Xerox Corporation, Stamford, Conn.

[21] Appl. No.: 812,470

[22] Filed: Dec. 23, 1991

[51] Int. Cl.[5] ..... G03G 9/125

[52] U.S. Cl. ..... 430/112; 430/114

[58] Field of Search ..... 430/112, 114, 115, 137; 355/256

[56] References Cited

U.S. PATENT DOCUMENTS

| | | | |
|---|---|---|---|
| 2,899,335 | 8/1959 | Straugham | 117/37 |
| 3,397,254 | 8/1968 | Wynstra et al. | 260/835 |
| 3,900,412 | 8/1975 | Kosel | 252/62.1 |
| 3,900,512 | 8/1975 | Sih | 260/468 |
| 3,963,486 | 6/1976 | Tamai et al. | 96/1 |
| 3,968,044 | 7/1976 | Tamai et al. | 252/62.1 |
| 3,998,747 | 12/1976 | Yamakami et al. | 252/62.1 |
| 4,052,325 | 10/1977 | Santilli | 252/62.1 |
| 4,134,881 | 1/1979 | Cuddihy et al. | 528/299 |
| 4,157,974 | 6/1979 | Brechlin et al. | 252/62.1 |
| 4,202,785 | 5/1980 | Merrill et al. | |
| 4,275,189 | 6/1981 | Danick et al. | 528/296 |
| 4,507,377 | 3/1985 | Alexandrovich | |
| 4,543,313 | 9/1985 | Mahabadi et al. | |
| 4,557,991 | 12/1985 | Takagiwa et al. | |
| 4,631,244 | 12/1986 | Mitchell | |
| 4,659,640 | 4/1987 | Santilli | |
| 4,702,984 | 10/1987 | El-Sayed et al. | |
| 4,702,985 | 10/1987 | Larson | 430/115 |
| 4,707,429 | 11/1987 | Trout | 430/137 |
| 4,734,352 | 3/1988 | Mitchell | 430/115 |
| 4,740,444 | 4/1988 | Trout | 430/137 |
| 4,740,580 | 4/1988 | Merck et al. | 528/272 |
| 4,784,333 | 11/1988 | Hikake et al. | 241/5 |
| 4,812,377 | 3/1989 | Wilson et al. | 430/109 |
| 4,833,057 | 5/1989 | Misawa et al. | 430/109 |
| 4,844,349 | 7/1989 | Kanda et al. | 241/19 |
| 4,859,560 | 8/1989 | Nakamura et al. | 430/137 |
| 4,877,704 | 10/1989 | Takagiwa et al. | 430/99 |
| 4,900,647 | 2/1990 | Hikake et al. | 430/137 |
| 4,917,309 | 4/1990 | Zander et al. | 241/5 |
| 4,923,778 | 5/1990 | Blair et al. | 430/137 |
| 4,925,763 | 5/1990 | Tsubuko et al. | 430/106 |
| 4,930,707 | 6/1990 | Oshiro et al. | 241/24 |
| 4,935,252 | 6/1990 | Nishikawa et al. | 430/109 |
| 4,935,327 | 6/1990 | Takizawa et al. | 430/110 |
| 4,966,825 | 10/1990 | Suzuki et al. | 430/137 |
| 4,981,923 | 1/1991 | Hagiwara et al. | 525/440 |
| 4,988,600 | 1/1991 | Jongewaard et al. | 430/114 |
| 4,988,602 | 1/1991 | Kok et al. | 430/110 |
| 5,006,441 | 4/1991 | Kato | 430/114 |
| 5,006,612 | 4/1991 | Danick et al. | 525/438 |
| 5,017,451 | 5/1991 | Larson et al. | 430/137 |
| 5,037,057 | 8/1991 | Andrews | 248/460 |
| 5,037,715 | 8/1991 | Hagiwara et al. | 430/109 |
| 5,121,164 | 6/1992 | Landa et al. | 355/256 |

*Primary Examiner*—John Goodrow
*Attorney, Agent, or Firm*—Oliff & Berridge

[57] ABSTRACT

A high solids replenishable electrostatic liquid developer concentrate contains toner particles formed from a urethane modified polyester. This composition can be concentrated up to toner solids and subsequently sonicated to a working strength dilution.

46 Claims, No Drawings

HIGH SOLIDS REPLENISHABLE LIQUID DEVELOPER CONTAINING URETHANE-MODIFIED POLYESTER TONER RESIN

FIELD OF THE INVENTION

1. Field of the Invention

The present invention relates to a high solids replenishable liquid electrostatic developer and a method for making the developer.

2. Background

An electrostatographic printing machine such as a photocopier, laser printer, facsimile machine or the like employs an imaging member that is exposed to an image to be printed. Exposure of the imaging member records an electrostatic latent image on it corresponding to the informational areas contained within the image to be printed. The latent image is developed by bringing a developer material into contact therewith. The developed image is transferred to a support material such as paper either directly or via an intermediate transport member. The developed image on the support material is generally subjected to heat and/or pressure to permanently fuse it thereto.

Many types of developer compositions, including both dry developer compositions and liquid developer compositions, have been proposed for use in the development of latent electrostatic images. Dry developer compositions typically suffer from the disadvantage that distribution of the dry toner powder contained therein on the surface of the element bearing the latent image is difficult to control. These dry developers have the further disadvantage that the use thereof may create excessive amounts of dust and that high resolution is often difficult to obtain due to the generally relatively large size of the dry developer powder particles.

Many of the disadvantages accompanying the use of dry developer compositions have been avoided by the use of liquid developers. Liquid developers have a number of advantages over the use of dry developers. Because liquid developers contain smaller toner particles than dry developers, they produce higher resolution images. As liquid developers are pumped through tubing within the machines, there are no dusting problems that commonly arise with the use of dry developers. Additionally, because liquid developers are not tribocharged, they are less sensitive to humidity.

Liquid developers are usually comprised of an electrically insulating liquid which serves as a carrier and which contains a stable dispersion of charged particles known as toner particles comprising a pigment such as carbon black, generally associated with a resinous binder, such as, for example, an alkyd resin. A charge control agent is often included to stabilize the magnitude and polarity of the charge on the toner particles. In some cases, the binder itself serves as a charge control agent. Liquid developers can also have soluble ionic material in solution known as charge directors which impart a charge on the toner particles.

To achieve suitable physical stability of the toner particles dispersed in conventional liquid electrographic developers, any of several types of various "stabilization" additives are incorporated to prevent the toner particles from settling out of the carrier liquid. However, stabilized liquid developer compositions tend to become "deactivated" within a few weeks and the toner particles tend to agglomerate or settle out of the developer. Consequently, the resultant liquid developer composition containing conventional liquid developer toner particles tends to become incapable of producing electrostatic prints of good quality and density. Once the toner particles settle out of the developer suspension, it is often difficult to redisperse them, and, even if redispersed, it is often found that the redispersed liquid developer does not possess the same developer characteristics as the original developer.

Because stabilization in liquid developers has been and is still a difficult problem to overcome, liquid developers are often prepared in the form of so-called "concentrates", i.e., mixtures of resins, pigments and/or dyes with a low liquid content. (See Santilli, U.S. Pat. No. 4,052,325.) These concentrates are stable and exhibit a relatively long shelf life. The loss of stability which occurs in conventional liquid developers, as noted hereinabove, occurs primarily in the diluted form of the concentrate which is the "working" form of the developer, i.e., the form of developer composition actually used in most electrographic developing processes.

Stability in "working" liquid developer compositions may be improved to some extent by the use of the various stabilization agents disclosed in U.S. Pat. No. 2,899,335 (York). These additives are most effective in a developer when used in conjunction with toner particles having a very small particle size. However, even in these situations where stability is achieved in working developers, this stability is often accompanied by too high a developer sensitivity which tends to result in a high degree of background density in the resultant liquid developed electrographic images.

Another problem associated with conventional "stabilized" liquid developers has been the problem of replenishment. Once the developer is used to produce a number of developed images, the developer becomes depleted of toner particles and must be replenished.

In addition to the "stabilized" liquid developers described above, various "redispersible" liquid developers have been formulated which are characterized by toner particles which, upon settling out of suspension with the liquid carrier vehicle of the developer, are readily redispersed in the liquid carrier and, when so redispersed, exhibit developer characteristics similar to the original developer. However, various problems still exist with many of these "redispersible" developers. For example, the toner particles of many of these developers cannot be readily fixed, except to rough-surfaced toner image receiving sheets such as conventional zinc oxide coated papers, using preferred fixing temperatures of about 100° C. or less. These developers, therefore, cannot be employed, except with further binder addenda, in various transfer processes because these processes use smooth surfaced toner-image receiving elements, such as dielectric resin-coated papers, i.e. papers coated with a film-forming dielectric resin. Still other available redispersible developers, although redispersible at ordinary room temperatures, exhibit pronounced caking or agglomeration of the toner particles when subjected to extended periods of storage (e.g., 24 hours) at temperatures above room temperature, and cannot be readily dispersed.

U.S. Pat. No. 4,052,325 (Santilli) discloses a liquid developer containing heat-fixable toner particles, wherein the toner particles contain a linear polyester polymer. The polyester polymer may have a structural formula as follows:

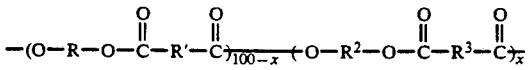

Diols and dicarboxylic acids may be used to prepare the polyester polymer. The diols may include aliphatic, alicyclic, and aromatic diols such as bisphenols, alkylene glycols or monocyclic and polycyclic diols. The dicarboxylic acids may include aliphatic, alicyclic and aromatic dicarboxylic acids, acid anhydrides and acid halide salts. A process of preparing a liquid developer comprises the steps of: (1) dissolving the polyester polymer in a suitable solvent in a ball mill wherein a pigment or other additives may be added forming a polymer-solvent mixture; (2) separating the mixture from the milling beads and the solvent; and (3) grinding the resulting dry polymer-containing material in a ball mill with a small amount of a liquid carrier vehicle creating a developer concentrate.

Currently envisioned liquid developer printing machines require high solids replenishment to minimize the buildup of excess liquid carrier in the machine. This is because the liquid carrier and the toner are depleted at uneven rates depending on the amount of toner solids taken by each image, the degree to which carrier fluid imbibes into toner solids, the rate at which the paper or receiver sheet absorbs carrier fluid, and the rate at which carrier fluid is lost by evaporation. Theoretically, all carrier fluid is permanently contained in the printing machine and steps are taken to eliminate carrier losses.

Where image density is high, large quantities of toner solids are used while fluid loss is virtually zero. As toner solids are depleted, the volume of the bath changes negligibly. Replenishing the bath with toner concentrate at 10% solids, for example will cause t he volume of the bath to grow very quickly, since 9 parts fluid are being added with every one part solids. Every added liter of concentrate causes the bath volume to grow nearly one liter. Consequently, the excess fluid must be removed, at considerable expense. As the efficiency of carrier fluid containment increases, it becomes necessary to replenish the developer with concentrates of increasingly higher concentration to prevent bath growth. However, desirably high concentrations have not previously been attained.

In liquid developer processes, the toner and the liquid carrier are mixed in the liquid carrier bath. The liquid carrier bath is pumped to a developer housing. Rollers take fluid from the developer housing and meter it onto an image receptor such as a photoreceptor drum. At the photoreceptor drum, the solids are depleted out. The photoreceptor drum rotates and transfers the image to an intermediate sheet. The liquid carrier remaining on the drum is removed by cleaning blades as the drum rotates. This excess liquid carrier is returned to the developer housing. When the developer housing "overflows", the excess liquid carrier is returned to the toner bath.

U.S. Pat. No. 4,833,057 (Misawa et al.) discloses a dry toner composition comprised of a urethane-modified polyester as its main component which can produce a high resolution image by using only a small quantity of heat at a high copying speed. The resin is derived from the reaction of a polyester resin having a number average molecular weight of 1,000 to 15,000 with an isocyanate compound, in which the mole-equivalent ratio between the hydroxyl group of the polyester resin and the isocyanate group of the isocyanate compound is within a specific range. The resulting resin has a glass transition temperature of 40°-80° C. The aforementioned toner composition is said to have a good fixing property at a low temperature and a good offset resistance at a high temperature. The polyester resin is obtained by polycondensation of a polycarboxylic acid and a polyhydric alcohol. The preparation of the toner composition comprises mixing the urethane-modified polyester resin or resin mixture pulverized to a particle size of about 0.5 to about 2 μm with carbon, adding an acrylic resin, a styrene resin, an epoxy resin, a maleic acid-modified resin, a magnetic powder such as ferrite or magnetite, a small amount of charge controlling agent and a wax according to need, blending the mixture, melt-kneading the mixture at a temperature of 100°-80° C. by a kneader or the like, and pulverizing and classifying the formed mass to obtain particles having a particle size of 5 - 20μm.

U.S. Pat. Nos. 4,981,923 and 5,037,715 (Hagiwara et al.) disclose a urethane-modified polyester resin for a dry toner and a method for manufacture. The urethane-modified polyester resin has a glass transition temperature ranging from 40° to 75° C. The urethanemodified polyester resin is obtained by reacting a polyester resin mixture with an isocyanate compound in an amount ranging from 0.3 to 0.99 molar equivalent per molar equivalent of the hydroxyl group of the polyester resin while continuously kneading the reaction mixture using a means such as a single or twin screw extruder.

U.S. Pat. No. 4,543,313 (Mahabadi et al.) discloses a dry toner composition comprised of resin particles selected from the group consisting of thermotropic liquid crystalline polycarbonates, copolycarbonates, polyurethanes, polyesters and copolyesters, pigment particles and optional charge particles. The toner compositions can be prepared by a number of known methods including melt-blending the toner resin particles, pigment particles, or colorants, followed by mechanical attrition, extrusion processing or similar methods such as spray drying, melt dispersion, direct dispersion polymerization, and direct suspension polymerization. In one method, a solvent dispersion of the resin particles and the pigment particles is spray dried under controlled conditions to result in the desired product.

U.S. Pat. No. 3,998,747 (Yamakami et al.) discloses a dry negatively charged toner which comprises a saturated or unsaturated polyester resin having a softening point of from 80° to 150° C. and produced from a polyol component, a dicarboxylic acid component and an organic pigment. The specific polyester resins and organic pigments are mixed and kneaded in a molten state by conventionally known methods followed by pulverization of the kneaded mixture to a particle size of about 1 to 30 microns.

SUMMARY OF THE INVENTION

An object of this invention is to provide a liquid electrostatic developer which is suited to the requirements of a printing machine having extremely efficient carrier fluid containment. It is thus an object of this invention to provide an electrostatic liquid developer which is readily replenished by a high solids liquid developer concentrate, in which little energy is required to break apart agglomerated particles. Further objects of the invention include providing a method for making an electrostatic liquid developer which entraps reduced levels of carrier fluid in the developed image, transfers electrostatically from photoreceptor to receiver without placing rigorous tolerances on the electrostatic settings of the hardware, produces high resolution images, and functions in a full color system.

These and other objects are achieved by the invention of a high solids replenishable electrostatic liquid developer concentrate and liquid electrostatic developer, comprising a urethane-modified polyester resin and a liquid carrier. The solids content of the developer concentrate can be greater than about 50%, and preferably greater than about 90%.

DETAILED DESCRIPTION OF PREFERRED EMBODIMENTS

Containment of carrier fluid will be an important feature of currently envisioned liquid toner printing machines. It is sought to develop a machine which will operate as a completely closed system, and will eliminate operator handling of carrier fluid. Consequently, it will be necessary to have a high solids replenishable developer.

Since the cost of removing waste toner dispersant is considerable in liquid developer based printing machines, high solids replenishment is an important feature to eliminate bath growth.

Current liquid developers can only be concentrated to about 50% solids, beyond which redispersion is extremely difficult. The liquid developer concentrate of this invention can have a toner solids concentration greater than about 50%, preferably in the range of as high as about 90% up to about 100%, and can be redispersed with about five minutes of sonication to working strength concentration.

The high solids replenishable electrostatic developer concentrate of the invention comprises toner particles containing a urethane modified polyester and a colorant blended with a liquid toner dispersant. The urethane modified polyester is a reaction product of a polyester resin and an isocyanate compound. The developer concentrate may be further comprised of a charge director. It preferably has a solids content above 50%, and more preferably above 90%.

The preferred toner dispersant of the invention is a non-polar liquid having a kauri-butanol value of less than 30. Preferably, it is a branched-chain aliphatic hydrocarbon. More particularly, a non-polar liquid of the Isopar® series may be used in the present developers. These hydrocarbon liquids are narrow cuts of isoparaffinic hydrocarbon fractions with extremely high levels of purity. For example, the boiling range of Isopar®G is between 157° C. and 176° C.; Isopar®H is between about 176° C. and 191° C.; Isopar®K is between about 177° C. and 197° C.; Isopar®L is between 188° C. and 206° C.; Isopar®M is between 207° C. and 254° C.; and Isopar®V is between 254.4° C. and 329.4° C. Isopar®L has a mid-boiling point of approximately 194° C. Isopar®M has an auto ignition temperature of 338° C. Isopar®G has a flash point of 40° C. as determined by the tag closed cup method; Isopar®H has a flash point of 53° C. as determined by the ASTM D-56 method; Isopar®L has a flash point of 61° C. as determined by the ASTM D-56 method and Isopar®M has a flash point of 80° C. as determined by the ASTM D-56 method and an auto-ignition temperature of 338° C. They are substantially odorless, possessing only a very mild paraffinic odor. They have excellent odor stability and are all manufactured by the Exxon Corporation. High-purity normal paraffinic liquids, Norpar®12, Norpar®13 and Norpar®15 (Exxon Corporation) may also be used. They have flash points of 69° C., 93° C. and 118° C., respectively, and have auto-ignition temperatures Of 204° C., 210° C. and 210° C., respectively.

The formation of suitable urethane-modified polyester resins which may be used in the present invention is described in U.S. Pat. Nos. 4,833,057 (Misawa et al.) 4,981,923 (Hagiwara et al.) and 5,037,715 (Hagiwara et al.) (each of which is hereby incorporated by reference). There is, for example, a urethane-modified polyester resin (C) obtained by reacting a polyester resin (A) having a number average molecular weight of 1,000 to 15,000 with an isocyanate compound (B) in an amount of 0.05 to 0.95 mole-equivalent per mole of the hydroxyl group of the polyester resin (A). The urethane-polyester resin (C) has a glass transition temperature of about 40°–about 80° C.

The polyester resin (A) can be obtained by polycondensation of a polycarboxylic acid and a polyhydric alcohol. Suitable polycarboxylic acids include aliphatic dibasic acids such as malonic acid, succinic acid, glutaric acid, adipic acid, azelaic acid, sebacic acid and hexahydrophthalic anhydride; aliphatic unsaturated dibasic acids such as maleic acid, maleic anhydride, fumaric acid, itaconic acid, and citraconic acid; aromatic dibasic acids such as phthalic anhydride, phthalic acid, terephthalic acid and isophthalic acid; and lower alkyl esters thereof. Among these polycarboxylic acids, an aromatic dibasic acid and/or a lower alkyl ester thereof is preferred.

Suitable polyhydric alcohols include, for example, diols such as ethylene glycol, 1,2-propylene glycol, 1,3-propylene glycol, 1,3-butylene glycol, 1,4-butylene glycol, 1,6-hexane diol, neopentyl glycol, diethylene glycol, dipropylene glycol, hydrogenated bisphenol A, an ethylene oxide adduct of bisphenol A and a propylene oxide adduct of bisphenol A; and triols such as glycerol, trimethylol propane and trimethylol ethane. Among these polyhydric alcohols, a propylene oxide adduct of bisphenol A is preferred.

Known high-temperature polycondensation and solution polycondensation processes can be adopted for the polycondensation. For example, the polycondensation temperature may be about 200° C. to about 2[illegible] C. and the polycondensation time may be about 3 to about 20 hours.

The ratio between the amounts of the polycarboxylic acid and polyhydric alcohol used is generally such that the ratio of the hydroxyl groups of the latter to the carboxyl groups of the former is in the range of from about 0.8 to about 1.4. The number average molecular weight of the polyester resin (A) is 1,000 to 15,000. If the number average molecular weight of the polyester resin (A) is lower than 1,000, the offset resistance of the urethane-modified polyester resin (C) is reduced and good results cannot be obtained. If the number average molecular weight of the polyester resin (A) is higher than 15,000, the viscosity is drastically increased at the reaction between the polyester resin (A) and the polyisocyanate (B) and too high a molecular weight is not preferred from the viewpoint of the production. Moreover, in this case, the fixing property of the urethane-modified polyester resin (C) is degraded and good results cannot be obtained. If the number average molecular weight is in the range of from 6,000 to 10,000, the heat resistance of the obtained urethane-modified polyester resin (C) is very high, reduction of the molecular weight is hardly caused at the melt-kneading step in the production of the toner, offset resistance is good and fogging is not caused in an image. Accordingly, the molecular weight within the above-mentioned range is especially preferred. If the number average molecular weight is lower than 6,000, reduction of the molecular weight of the urethane-modified polyester resin (C) is caused at the melt-kneading step, fogging may be caused and offset resistance may be readily degraded.

Polyisocyanates (B) suitable for use in the present invention can include, for example, diisocyanates such as hexamethylene diisocyanate, isophorone diisocyanate, tolylene diisocyanate, diphenylmethane diisocyanate, xylylene diisocyanate and tetramethylxylylene diisocyanate, and tri-functional to hexa-functional polyisocyanates represented by the following formulae (1) through (5).

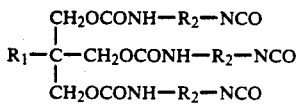

(1)

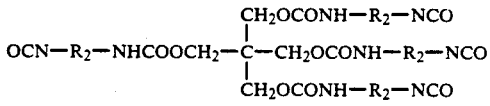

(2)

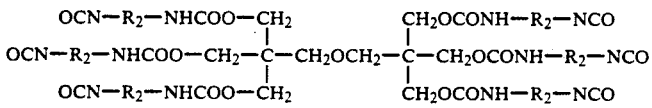

(3)

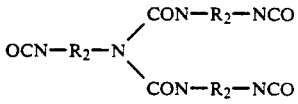

(4)

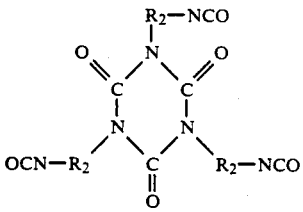

(5)

In the above formulae, $R_1$ stands for a group selected from H—, $CH_3$— and $CH_3CH_2$—, and $R_2$ stands for at least one group selected from $-(CH_2)_6$,

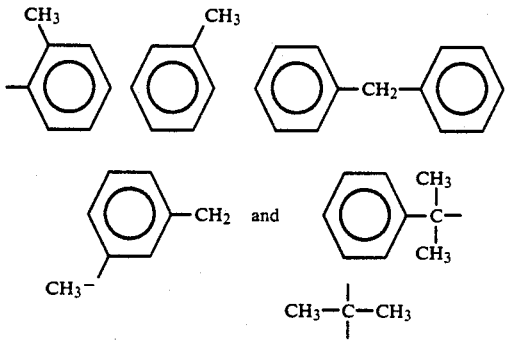

$R_2$ in one formula may be the same or different.

Generally, the isocyanate compound (B) is used in an amount of 0.05 to 0.95 mole-equivalent per mole of the hydroxyl group of the polyester resin (A). If the amount of the isocyanate compound (B) is smaller than 0.05 mole-equivalent, the offset resistance of the toner is degraded and good results cannot be obtained. If the amount of the isocyanate compound (B) exceeds 0.95 mole-equivalent, the viscosity is greatly increased during the reaction and gelation of the urethane-modified polyester resin (C) is caused in some cases.

When a diisocyanate is used as the isocyanate compound (B), in view of the offset resistance, it is preferred that the amount of the diisocyanate be about 0.3 to about 0.95 mole-equivalent, especially 0.4 to 0.9 mole-equivalent. When a tri-functional to hexa-functional isocyanate is used as the isocyanate compound (B), in view of the offset resistance and the preparation easiness, it is preferred that the isocyanate compound be used in an amount of 0.05 to 0.3 mole-equivalent, especially 0.1 to 0.25 mole-equivalent.

The urethane-modified polyester resin (C) can be prepared, for example, according to the following process. Namely, the isocyanate compound (B) is added collectively or dividedly to the polyester resin (A) alone or in a solution containing the polyester resin (A) at a temperature of 80° to 150° C., and the reaction is carried out at this temperature for several hours to obtain the urethane-modified polyester resin.

In the present invention, the urethane-modified polyester resin (C) alone can be used, but if the urethane-modified polyester resin (C) is used in combination with a polymer (D) having a number average molecular weight of 1,000 to 1,000, the pulverizability is improved and the fixing property is improved, and good results can be obtained. A polyester resin or a vinyl copolymer is preferably used as the polymer (D).

Other methods of manufacturing this or other urethane modified polyester resins may be used. This method of producing a urethane modified polyester produces a polyester with numerous carboxyl terminated end groups. It is believed that toners of this invention obtain their charge by deprotonating in the presence of charge director micelles, which form loosely attached counterions. Carboxyl termination thus provides readily reactive sites for the formation of toner charge.

The resin may be blended with any suitable colorant. Suitable pigments include, but are by no means limited to, carbon black for producing a black toner; 2,9-dimethyl-substituted quinacridone and anthraquinone dye (identified in the color index as CI 60710), CI Dispersed Red 15, a diazo dye identified in the color index as CI 26050, and CI solvent Red 19 for producing a magenta toner; copper tetra-4(octadecyl sulfonamido)phthalocyanine, X-copper phthalocyanine pigment (listed in the color index as CI 74160), CI Pigment Blue, and Anthrathrene Blue, identified in the color index as CI 69810, and Special Blue X-2137, for producing a cyan toner; diarylide yellow 3,3-dichlorobenzidene acetoacetanilides, a monoazo pigment identified in the color index as Foron yellow SE/GLN, CI dispersed yellow 33, 2,5-dimethoxy-4-sulfonanilide phenylazo-4'-chloro-2,5-dimethoxy acetoacetanilide, and permanent yellow FGL for producing a yellow toner. Examples of other pigments that may be used include:

| Pigment Brand Name | Manufacturer | Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Hoechst | Yellow 74 |
| Hansa Yellow X | Hoechst | Yellow 75 |
| Novoperm ® Yellow HR | Hoechst | Yellow 75 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |

-continued

| Pigment Brand Name | Manufacturer | Pigment |
|---|---|---|
| Tipure ® R-101 | Du Pont | |
| Mogul L | Cabot | |
| BK 8200 Black Toner | Paul Uhlich | |

The pigment and the resin may be blended in any suitable manner. Preferably, they are melt blended, more preferably in an extruder such as in a twin screw extruder to permit continuous production. The screw elements are configured to grind, and the pigment is broken up into sub-micron particles and dispersed into the resin. The ratio of resin to pigment is preferably about 80% to about 20% by weight. However, the ratio of resin to pigment may range from about 40% to about 99.9% by weight resin to about 60% to about .1% by weight pigment.

In a preferred twin screw extruder, there are three specific temperature zones. In the feed zone, resin, additive and pigment are metered into the extruder. The temperature is maintained below the resin melt point. If the resin begins to melt at the feed port, the entry clogs, and the extruder often stalls.

In the mixing zone, the temperature of the barrel is held just above the resin melting point, at approximately 111° C. bringing the conveyed mass to a high viscosity, molten state. Reverse directing screw elements cause the advancing blend to swirl backwards into the forwardmoving blend, causing a rise in pressure. In this high energy state, pigment particles are crushed and blended into the molten resin. Pigment and optional additives mix uniformly into the liquified resin. If, during this stage, the temperature is temporarily lowered, the resin viscosity increases.

At the discharge port, the temperature is raised up to about 170° C. to fluidize the extrudate and causes it to flow freely out the exit. The pressure in the preceding mixing zone can be increased by restricting the size of the exit hole, at the expense of throughput.

The screws are preferably turned at the fastest rate which allows the molten resin to achieve the desired temperatures. Faster screw speeds provide higher energy mixing and greater throughputs, but above a certain rate, the resin is moving too fast to equilibrate with the barrel temperature, and dispersion quality degrades.

As an example, a Werner Pfleiderer WP-28 extruder equipped with a 15 horsepower motor is well-suited for melt-blending urethane modified polyester resin and a pigment. This extruder has a 28mm barrel diameter, and is considered semiworks-scale, running at peak throughputs of about 3 to 12 lbs/hour.

Dispersion quality improves when a "masterbatch" process is used. The resin is first extruded with a very high loading of pigment, for example 50% for cyan, magenta, and yellow, and 30% for black. The pigment acts as a self-grinding medium. This finished extrudate is then milled to a coarse powder and mixed, or "let down" with pure resin to lower pigment loading to the desired value. The mixture is passed through the extruder to produce the final product.

This masterbatch process is carried out in two discrete extrusions. An improved process begins as a normal batch, where a rich pigment-resin mixture is introduced at the feed port. This is melted and mixed, and at the end of the mixing zone, additional molten resin is injected into the extruder, and mixed in the next heating zone of the extruder. The product has the dispersion quality of the product of a full masterbatch process, but is delivered from the extruder at the proper pigment loading in a single pass.

Another improvement in pigment dispersion is achieved by using a chemical dispersant, such as, for example, Solsperse, an ICI product. These dispersants, which may be comprised of an alkane and a polar salt, such as copper cyanate, have no detrimental impact on the electrostatic properties of the toners. These dispersants, consist, in some cases, of two components, one of which bonds strongly to the pigments, and a second which mixes well into the resin system.

In an alternative method of blending the resin and a pigment, an attritor is outfitted with an oil bath, in order to achieve high temperatures, in the range of about 150° C. to near 200° C. where most polyesters are molten. Temperature control is obtained from about 25° C. to about 300° C. with a heating bath filled with Dow Corning 210H fluid. Cooling the molten polyester seizes the attritor, as viscosity rises to an unacceptably high level. Molten viscosities of over 25 polyester resins have been measured as a function of temperature on the Bohlen rotoviscometer, and all measured 50,000 cp to 1,000,000 cp at the melting temperature. Dodecanol may be added to the mix to soften the resin, but the shaft still seizes.

Nonetheless, toner solids can be chipped out of the attritor. High quality toners are prepared from this route. If the solidified resin could be broken up in the attritor sufficiently to allow the attritor shaft to spin, an all-attritor process would be feasible. Larger, more powerful attritors impart much greater energy to the mix, and most likely would not seize.

In yet another variation of the pigmentation process, resin and pigment are mixed together dry in a high-shear mixer. If enough heat is generated, the resin softens adequately to incorporate pigment. The advantages of the process are that pigmentation and particle size reduction occur simultaneously, and the toner is prepared completely dry. The disadvantage is that pigment agglomerates are not broken down. This approach is suited to an application where color control is not critical.

A further process involves the step of dissolving the resin in a low-boiling solvent and mixing the solution with pigment. The solvent is evaporated to produce pigmented resin. This produces a very uniform mixture, but does not break down pigment agglomerates and requires a volatile solvent.

An important property of toners is brittleness, which causes the resin to fracture when impacted. This allows rapid particle size reduction in attritors, other media mills, or even jet mills used to make dry toner particles.

After the resin and the pigment have been blended together, the particles of the resin-pigment mixture are reduced in size, and added to a toner dispersant. The reduction in size of the resin pigment particles may be accomplished by any number of ways including, for example, the use of attritors, pulverizers, mills, or fluidizers. Other means are also acceptable.

As an example, extruder solids can be added without post-processing to an attritor with Isopar®, but larger pieces can not be taken into the media. It is thus preferable to pregrind large pellets in a mill such as a hammer mill to produce a coarse powder, which then mixes readily into the attritor media. With a fine pelletizer at the extruder output, the coarse grind step may be eliminated.

Horizontal mills from Premier and Netzsch and vertical mills from Drais may be used to reduce particle size, all with excellent results. Coarse toner slurry is pumped into these mills, and backing pressure forces the material to advance through the media and out an exit port. The Netzsch mill reduces particle size faster than the Premier mill. The Drais mill is much larger, and produces toner at higher throughput.

The concentration of the toner slurry, the rpms (revolutions per minute) of the shaft of the mill, the media size and the residence time all affect the efficiency of attritors in grinding the toner particles. Best results are achieved with high slurry concentration, high shaft rpm, 0.5 mm media, and about 3 to about 10 minute residence times.

The toner particle size can also be reduced in a liquid jet interaction chamber, of the general description disclosed in U.S. Pat. No. 4,533,254, which is hereby incorporated by reference. A preferred apparatus is the MICROFLUIDIZER® emulsifier, available from Microfluidics Corporation in Newton, MA. However, there can be no particles larger than about 100 μm in diameter in the feed slurry or the interaction chamber of the fluidizer clogs.

After particle size reduction, the toner particles have an average particle size of less than 30 μ, preferably less than 15 μ, more preferably less than 10 μ, as measured using a Malvern 3600E Particle Sizer® manufactured by Malvern, Southborough, Mass., which uses laser diffraction light scattering of stirred samples to determine average particle sizes. Various instruments are known to measure particle size in addition to the Malvern instrument, such as the Horiba CAPA-500® centrifugal particle analyzer, manufactured by Horiba Instruments, Inc., Irvine, California. In determining particle size by area, a solvent viscosity of 1.24 cps, solvent density of 0.76 g/cc, sample density of 1.32 using a centrifugal rotation of 1,000 rpm, a particle size by area range of 0.01 to less than 10 μm, and a particle size by area cut of 1.0 μm are used.

Since these two instruments use differing techniques to measure average particle size, the readings differ. The following correlation of the average size of toner particles in micrometers for the two instruments is:

| Value Determined By Malvern 3600E Particle Sizer | Expected Range For Horiba CAPA - 500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification, the particle size values are as measured using the Malvern instrument.

Following the reduction of the toner particle size, the resin, which in most size reduction processes has been added to a toner dispersant, is concentrated to between about 50% to about 100% to form a high solids developer concentrate. There are a number of processes to increase the concentration of the resin in the developer concentrate, including, for example, vacuum and/or pressure filtering, alkane washing and filtering, centrifugation and gentle heating.

For example, the toner dispersion may initially, after the reduction of the toner particle size, be vacuum filtered to form a wet cake. In an alternative method, the toner may be pressure filtered. An initial filtering may result in a solids concentration of about 40% to about 50% or greater.

This cake may be mixed with an alkane such as hexane or some other low-boiling fluid in which the resin is insoluble. The resulting dispersion is vacuum filtered and dried, for example air dried. A solids content of greater than about 95% may be routinely achieved by this procedure. The percent solids is determined by baking a known mass of toner to complete dryness and measuring the weight lost.

In a variation of this method for concentrating the toner, the toner dispersant mixture is centrifuged to form a centrifuged dispersant mixture. The supernatant of the centrifuged dispersant mixture is replaced with a low boiling fluid such as hexane to form a mixture. The mixture is centrifuged, thereby separating a concentrated toner mass from the fluid. The remaining fluid is removed from the concentrated toner mass, preferably by vacuum or pressure filtering and air drying of the concentrated toner mass. It is possible to achieve a solids content of greater than about 95% by this procedure.

Since image formation depends on the differences of the charge between the liquid developer and the latent electrostatic image to be developed, it is desirable to add a charge director and/or an adjuvant. As an example, adjuvants which can be melt blended with the resin can be selected from the group consisting of a polyhydroxy compound which contains at least 2 hydroxy groups, aminoalcohol, polybutylene succinimide, metallic soap, and aromatic hydrocarbon having a Kauributanol value of greater than 30. The adjuvants are generally used in an amount of 1 to 1000 mg/g, preferably 1 to 200 mg/g developer solids. Examples of the various above described adjuvants include:

polyhydroxy compounds: ethylene glycol, 2,4,7,9-tetramethyl-5-decyn-4,7-diol, poly(propylene glycol), pentaethylene glycol, tripopylene glycol, trimethylene glycol, glycerol, pentaerythritol, glycerol-tri-12 hydroxystearate, ethylene glycol monohydroxystearate, propylene glycerol monohydroxystearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl) ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristerate; aluminum distearate; barium, calcium, lead and zinc stearate; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444 and is an additive. The metallic soap can be present in an amount of 0.01 to 60% in weight based on the total weight of solids.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 Alkyl-substituted benzenes manufactured by Exxon Corp., etc. as described in Mitchell U.S. Pat. No. 4,631,244.

The disclosures of the above-listed United States patents describing the adjuvants are incorporated herein by reference.

To acquire a negative or positive charge from a chemical dissociation reaction on the toner particles, a charged species may be introduced in the carrier liquid to form a counterion. A charge director in the liquid developer influences or is responsible for electrical charging of the toner. The charge director may have a positive or negative charging effect. Mostly oil-soluble ionogenic substances (surfactants), e.g., metallic salts of organic acids with long aliphatic chains (e.g., containing at least 6 carbon atoms), are used for that purpose. By predominant adsorption of one ionic species, the toner particles receive a net charge whose amount can be regulated by changing the additive concentration. In this way the sensitivity of the toner (i.e., deposited mass per surface charge) can be controlled. The polarity can be determined by appropriate choice of the surfactant. Mixtures of different charge directors can be used. For example, a mixture of different charge directors having opposite charging effects can be used so that the strength of the charge on the toner or the polarity thereof can be adjusted by varying the ratio between the different charge directors. Particularly suitable positively working charge directors are bivalent or trivalent metal salts of:

(a) a monoester or diester of an oxyacid derived from phosphorus;

(b) an oxyacid derived from phosphorus and containing one or two organic groups linked to the phosphorus atom by a carbon atom; or (c) an oxyacid derived from phosphorus and containing an ester group and an organic group linked by a carbon atom to the phosphorus atom, the organic group being aliphatic, cycloaliphatic or aromatic.

The organic groups preferably comprise a chain of at least 4 carbon atoms, most preferably from 10-18 carbon atoms, and such a chain may be substituted and/or interrupted by hetero-atom(s), e.g. oxygen, sulphur, or nitrogen atom(s).

Particularly good results are obtained with barium salts. However, other salts may be used, e.g., magnesium salts, calcium salts, strontium salts, zinc salts, iron salts, cobalt salts, nickel salts, copper salts, cadmium salts, aluminum salts, and lead salts.

The solubility in the electrically insulating carrier liquid of such metal salts can be promoted by the presence of one or more organic groups with a branched structure, e.g., branched aliphatic groups, such as a 2-butyl-octyl group.

In a preferred embodiment, particularly useful or effective positively charged charge directors that are of special interest in the production of an electrophoretic developer with low charge/toner particle mass ratio are metal alkyl sulphonates in which the metal ion is a bivalent metal ion selected from the group consisting of zinc(II), lead(II), cadmium(II), copper(II) and barium(IIA), or is a trivalent metal ion of the group VIII of the Periodic Table of the Elements, e.g., iron (III), or of the group VIB, e.g., chromium(III), and in which the sulphonate group is present directly on an alkyl chain containing at least 6 carbon atoms in a straight line.

A suitable amount of the sulphonate for a given developer can be easily determined by simple tests. By using a metal alkyl sulphonate as a charge control agent the specified results can be achieved with toner particles of a size commonly used in the electrophotographic art, e.g., with toner particles in the range of 0.2 to 2 μm. An additional charge director can be used in conjunction with the metal alkyl sulphonate, but this is not a requirement to charge the liquid resin toner.

Sufficient carrier fluid may be added to the concentrate (or vice versa) to achieve a liquid developer with a working strength concentration of the toner resin. The toner resin may be redispersed in the carrier fluid by, for example, sonicating the resin in a desired amount of carrier fluid, for example for about 3-8 minutes. The toner resin may also be sonicated in a standard laboratory ultrasonic bath. Alternatively, the toner can also be redispersed with a point sonicator. Other methods of sonication or redispersion may be used to achieve the desired concentration.

As an example of a preferred embodiment of the present invention, the surfactant Basic (TCF Dec. 17, 1991) Barium Petronate from Witco is used as a charge director. Basic (TCF Dec. 17, 1991) Barium Petronate is a barium salt of an alkane chain 16–20 carbons long with a sulfonate ($SO_3^{-2}$) to the end of the alkane chain. The Basic (TCF Dec. 17, 1991) Barium Petronate may be first mixed in with the toner resin dispersion after particle size reduction by an attritor or microfluidizer but prior to formation of a wet cake of toner resin. Approximately 15 mg of charge director are added per gram of toner resin. After the toner resin has been redispersed to about 1% solids, additional Basic (TCF Dec. 17, 1991) Barium Petronate may e added at the rate of about 15 mg of charge director per gram of toner resin. The amount of charge director which may be added ranges from about 15 mg of charge director to about 1 gram of charge director per gram of toner resin, with the optimum range of charge director being about 15 mg to about 150 mg, with 15 mg being the preferred amount of charge director added per gram of toner resin. Conductivity of the liquid toner should be about 10 pmho/cm.

Other charge directors which may be used with this resin include positive charge directors, e.g., anionic glycerides such as Emphos® D70-30C, Emphos®F27-85, etc., manufactured by Witco Chem. Corp., New York, N.Y.; sodium dioctylsulfosuccinate (manufactured by American Cyanamid Co.); ionic charge directors such as zirconium octoate, copper oleate, iron naphtenate, etc.; and nonionic charge directors such as polyethylene glycol sorbitan stearate.

While the invention has been described with reference to the structures and embodiments disclosed herein, it is not confined to the details set forth, and encompasses such modifications or changes as may come within the purpose of the invention.

What is claimed is:

1. A method for producing a readily redispersible high solids replenishable electrostatic liquid developer concentrate having a solids content of more than about 50%, comprising:

blending particles containing a urethane modified polyester resin and a colorant with a liquid toner dispersant to form a toner dispersant mixture, wherein the particles have an average particle size of less than 30 microns as measured by a centrifugal particle size analyzer.

2. The method according to claim i, wherein said urethane modified polyester resin has a glass transition temperature of about 40° C. to about 80° C.

3. The method according to claim 1, wherein said urethane-modified polyester resin is a reaction product of a polyester and an isocyanate compound.

4. The method according to claim 3, wherein said polyester has a number average molecular weight of about 1,000 to about 15,000.

5. The method according to claim 3, wherein said polyester is obtained by polycondensation of a polycarboxylic acid and a polyhydric alcohol such that a ratio of hydroxyl groups of the polyhydric alcohol to carboxyl groups of the polycarboxylic acid is in the range of from about .8 to about 1.4.

6. The method according to claim 3, wherein a ratio of the isocyanate compound to hydroxyl groups of the polyester resin is in the range of about 0.05 to about 0.95 mole-equivalent per mole of the hydroxyl groups.

7. The method according to claim 3, wherein said isocyanate compound is selected from the group consisting of hexamethylene diisocyanate, isophorone diisocyanate, tolylene diisocyanate, diphenylmethane diisocyanate, xylylene diisocyanate, tetramethylxylylene diisocyanate, and tri-functional to hexafunctional polyisocyanates.

8. The method according to claim further comprising reducing the size of s id particles in said toner dispersant mixture to form a reduced particle size toner dispersant mixture.

9. The method according to claim 1, wherein the size of said particles is reduced to between about .5 and about 10 microns.

10. The method according to claim 1, wherein the toner dispersant mixture is centrifuged to form a centrifuged dispersant mixture.

11. The method according to claim 1, wherein liquid toner dispersant of said toner dispersant mixture is replaced with a low boiling alkane to form an alkane mixture, and alkane is separated from said alkane mixture to produce a concentrated toner mass.

12. The method according to claim 1, wherein said solids content of the toner dispersant mixture is increased to more than about 90% solids.

13. A readily redispersible high solids replenishable electrostatic liquid developer concentrate having a solids content of more than about 50%, comprising toner particles containing a urethane modified polyester resin and a colorant, wherein the toner particles have an average particle size of less than 30 microns as measured by a centrifugal particle size analyzer; and a liquid toner dispersant.

14. The developer concentrate according to claim 13, wherein said urethane polyester resin has a glass transition temperature of about 40° C. to about 80° C.

15. The developer concentrate according to claim 13, wherein said urethane modified polyester resin is a reaction product of a polyester and an isocyanate compound.

16. The developer concentrate according to claim 15, wherein said polyester has a number average molecular weight of about 1,000 to about 15,000.

17. The developer concentrate according to claim 15, wherein said polyester is obtained by polycondensation of a polycarboxylic acid and a polyhydric alcohol such that a ratio of hydroxyl groups of the polyhydric alcohol to carboxyl groups of the polycarboxylic acid is in the range of from about .8 to about 1.4.

18. The developer concentrate according to claim 15, wherein a ratio of isocyanate compound to hydroxyl groups of the polyester resin is in the range of about 0.05 to about 0.95 mole-equivalent per mole of the hydroxyl groups.

19. The developer concentrate according to claim 15, wherein said isocyanate compound is selected from the group consisting of hexamethylene diisocyanate, isophorone diisocyanate, tolylene diisocyanate, diphenylmethane diisocyanate, xylylene diisocyanate, tetramethylxylylene diisocyanate, and tri-functional to hexafunctional polyisocyanates.

20. The developer concentrate according to claim 13, wherein a solids content of said concentrate is above about 90%.

21. The developer concentrate according to claim 13, wherein said toner particles have an average particle size of from about .5 micron to about 10 microns.

22. The developer concentrate according to claim 13, further comprising a charge director.

23. The developer concentrate according to claim 22, wherein said charge director is a metallic salt of an organic acid.

24. The developer concentrate according to claim 23, wherein said charge director is a metallic salt of a monoester or diester of an oxyacid selected from the group consisting of an oxyacid derived from phosphorus, an oxyacid derived from phosphorus and containing one or two organic groups linked to the phosphorus atom by a carbon atom, and an oxyacid derived from phosphorus and containing an ester group linked by a carbon atom to the phosphorus atom; a metal alkyl sulphonate; or lecithin.

25. The developer concentrate according to claim 13, wherein a fine particle size inorganic oxide is blended with said resin.

26. The developer concentrate according to claim 15, wherein the toner particles have dispersed therein a metallic soap.

27. An electrostatic liquid developer, comprising:

toner particles containing a urethane modified polyester resin and a colorant; and a liquid toner dispersant.

28. The developer according to claim 27, wherein said urethane modified polyester resin has a glass transition temperature of about 40° C. to about 80° C.

29. The developer according to claim 27, wherein said polyester resin is a reaction product of a polyester and an isocyanate compound.

30. The developer according to claim 29, wherein said polyester has a number average molecular weight of about 1,000 to about 15,000.

31. The developer according to claim 29, wherein said polyester is obtained by polycondensation of a polycarboxylic acid and a polyhydric alcohol such that a ratio of hydroxyl groups of the polyhydric alcohol to carboxyl groups of the polycarboxylic acid is in the range of from about .8 to about 1.4.

32. The developer according to claim 29, wherein a ratio of isocyanate compound to hydroxyl groups of the polyester resin is in the range of about 0.05 to about 0.95 mole-equivalent per mole of the hydroxyl groups.

33. The developer according to claim 29, wherein said isocyanate compound is selected from the group consisting of hexamethylene diisocyanate, isophorone diisocyanate, tolylene diisocyanate, diphenylmethane diisocyanate, xylylene diisocyanate, tetramethylxylylene diisocyanate, and tri-functional to hexafunctional polyisocyanates.

34. A method of replenishing toner solids in a liquid electrostatic developer in a liquid electrostatographic printing machine, comprising adding toner particles having an average particle size of less than 30 microns as measured by a centrifugal particle size analyzer and containing a urethane modified polyester resin and a colorant to a toner solids depleted liquid electrostatic developer in said machine, wherein said toner particles added to said electrostatic developer are in a readily redispersible composition having a solids content of greater than 50%.

35. The method according to claim 34, wherein said toner particles are added in a substantially dry state to said electrostatic developer.

36. The method according to claim 34, wherein said toner particles added to said electrostatic developer are in a liquid concentrate having a solids content greater than 90%.

37. The method according to claim 34, wherein said urethane modified polyester is a reaction product of a polyester resin and an isocyanate compound.

38. The method according to claim 37, wherein said polyester resin has a number average molecular weight of about 1,000 to about 15,000.

39. The method according to claim 34, wherein said urethane modified polyester resin has a glass transition temperature of about 40° C. to about 80° C.

40. A method for producing a high solids replenishable electrostatic liquid developer concentrate, comprising:

blending particles containing a urethane modified polyester resin and a colorant with a liquid toner dispersant to form a toner dispersant mixture, and increasing a solids content of said toner dispersant mixture.

41. The method according to claim 1 wherein the toner dispersant mixture has an average particle size of less than 30 microns.

42. The method according to claim 1 wherein the urethane modified polyester resin has a glass transition temperature of about 40° C. to about 80° C. and an average number molecular weight of about 1000 to about 15,000, and the toner dispersant mixture has an average particle size of less than 30 microns.

43. The developer concentrate according to claim 13, wherein the toner dispersant mixture has an average particle size of less than 30 microns.

44. The developer concentrate according to claim 13, wherein the urethane modified polyester resin has a glass transition temperature of about 40° C. to about 80° C. and an average number molecular weight of about 1000 to about 15,000, and the toner dispersant mixture has an average particle size of less than 30 microns.

45. The method according to claim 34, wherein the toner dispersant mixture has an average particle size of less than 30 microns.

46. The method according to claim 34, wherein the urethane modified polyester resin has a glass transition temperature of about 40° C. to about 80° C. and an average number molecular weight of about 1000 to about 15,000, and the toner dispersant mixture has an average particle size of less than 30 microns.

* * * * *